US007395789B2

(12) United States Patent
Ferman

(10) Patent No.: US 7,395,789 B2
(45) Date of Patent: Jul. 8, 2008

(54) CYLINDRICAL ENGINE

(75) Inventor: Marty Allen Ferman, St. Louis, MO (US)

(73) Assignee: Saint Louis University, St. Louis, MO (US)

( * ) Notice: Subject to any disclaimer, the term of this patent is extended or adjusted under 35 U.S.C. 154(b) by 0 days.

(21) Appl. No.: 11/490,887

(22) Filed: Jul. 21, 2006

(65) Prior Publication Data

US 2007/0017460 A1 Jan. 25, 2007

Related U.S. Application Data

(60) Provisional application No. 60/701,336, filed on Jul. 21, 2005.

(51) Int. Cl.
*F02B 75/18* (2006.01)

(52) U.S. Cl. ..... 123/56.1; 123/197.1

(58) Field of Classification Search ..... 123/56.1–56.9, 123/58.1, 197.1, 197.3, 197.4
See application file for complete search history.

(56) References Cited

U.S. PATENT DOCUMENTS 6,279,520 B1 * 8/2001 Lowi, Jr. ..... 123/56.1
6,718,936 B2 4/2004 Matsuda
6,752,108 B2 6/2004 Katayama
6,755,163 B2 6/2004 Katayama et al.
6,830,030 B2 12/2004 Imafuku et al.
6,877,467 B2 4/2005 Katayama
6,929,081 B2 8/2005 Pichler et al.
6,948,470 B2 9/2005 Tsutsumi et al.
6,952,923 B2 10/2005 Branyon et al.

* cited by examiner

*Primary Examiner*—Noah Kamen
(74) *Attorney, Agent, or Firm*—Sonnenschein, Nath & Rosenthal LLP; Marcellus A. Chase

(57) ABSTRACT

The invention is directed to an improved internal combustion engine, having a symmetric cylindrical arrangement and using a bevel gear train to join multiple crankshaft sections. It provides for a naturally smoother operation with less vibration than in-line engines. Better efficiency is expected with the engine than with comparable in-line engines. Manufacturing is expected to be simpler and gasket-sealing better than the in-line and V types of engines. Compactness will add to the engine's utility.

8 Claims, 10 Drawing Sheets

Overall View of Circular Engine

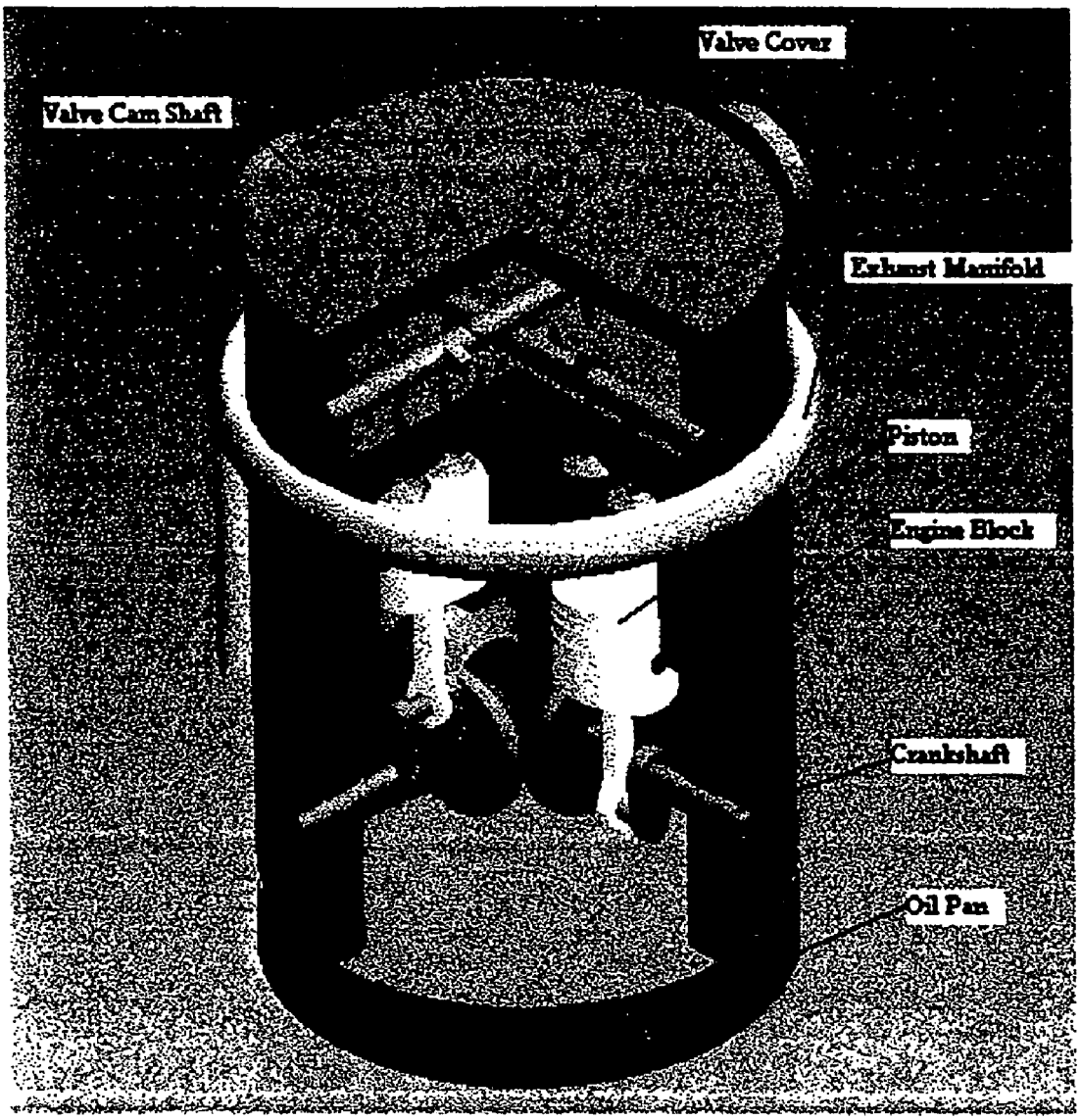
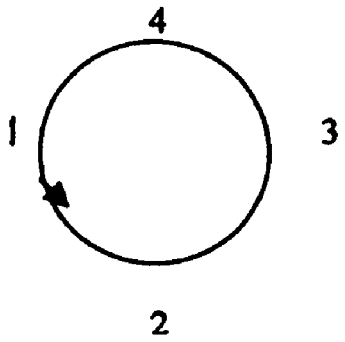
Figure 1- Overall View of Circular Engine

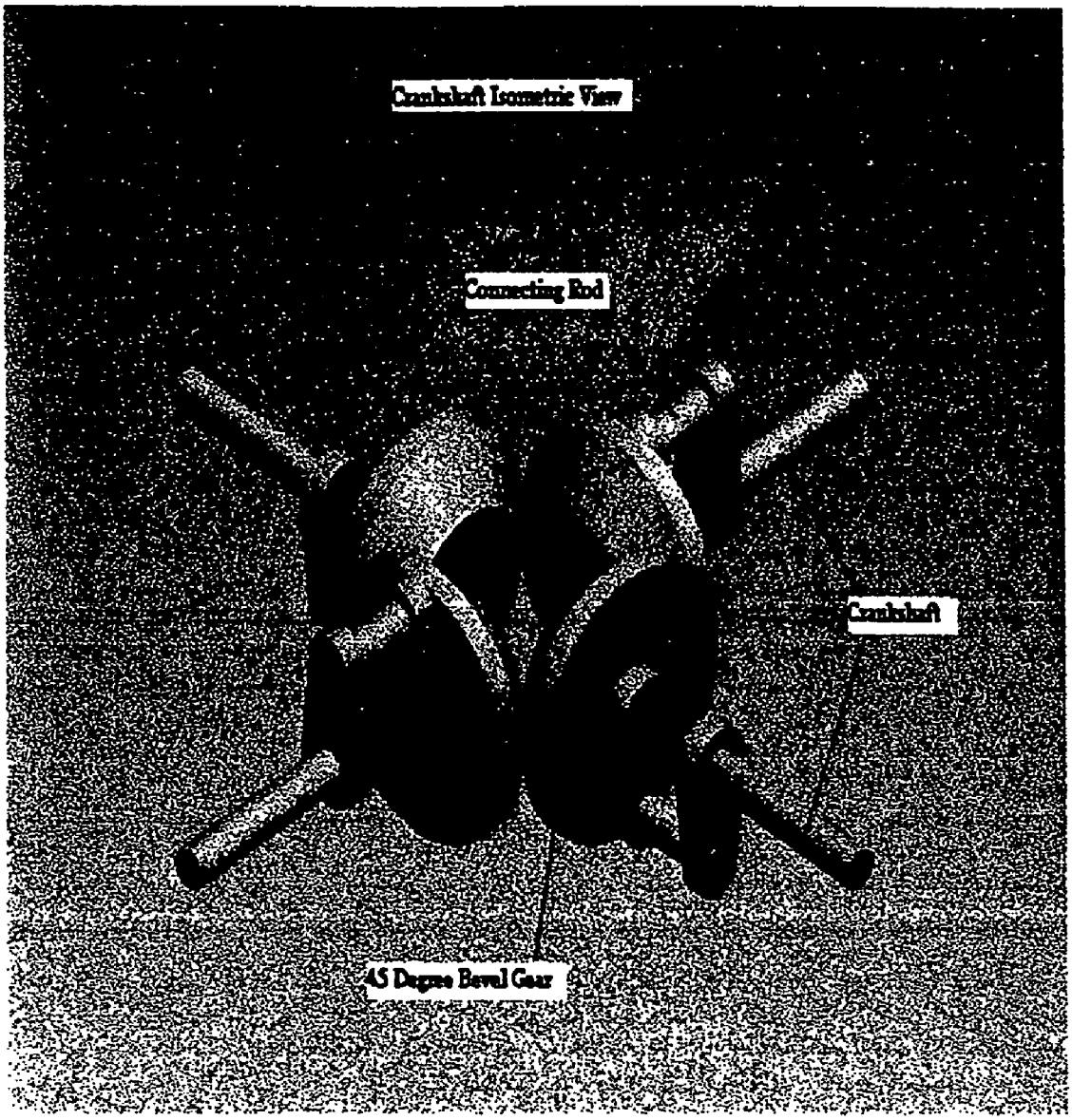
Figure 2 – View of Four-Segment Crankshaft with Bevel Gears

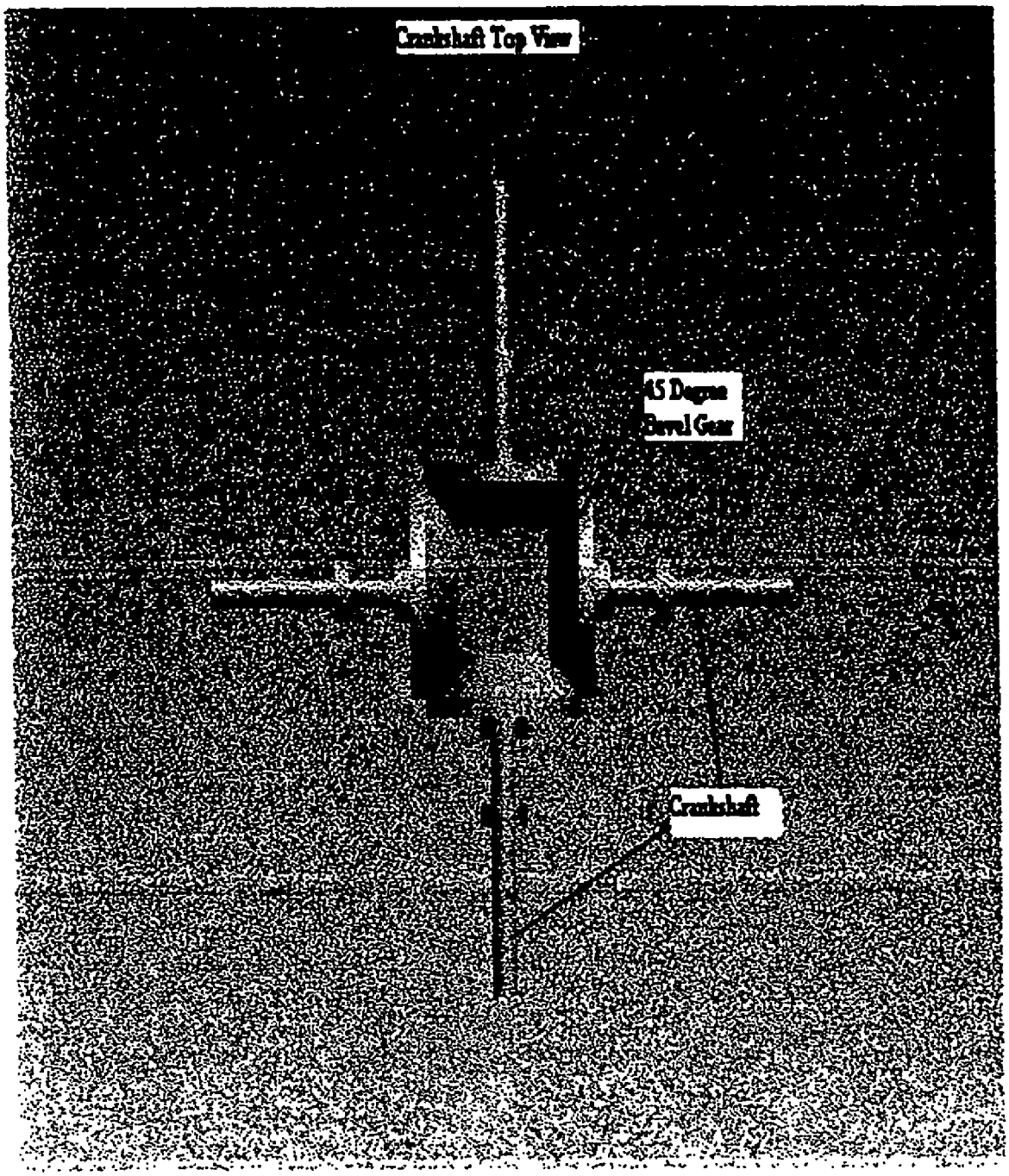
Figure 3- Top View of Crankshaft Sections

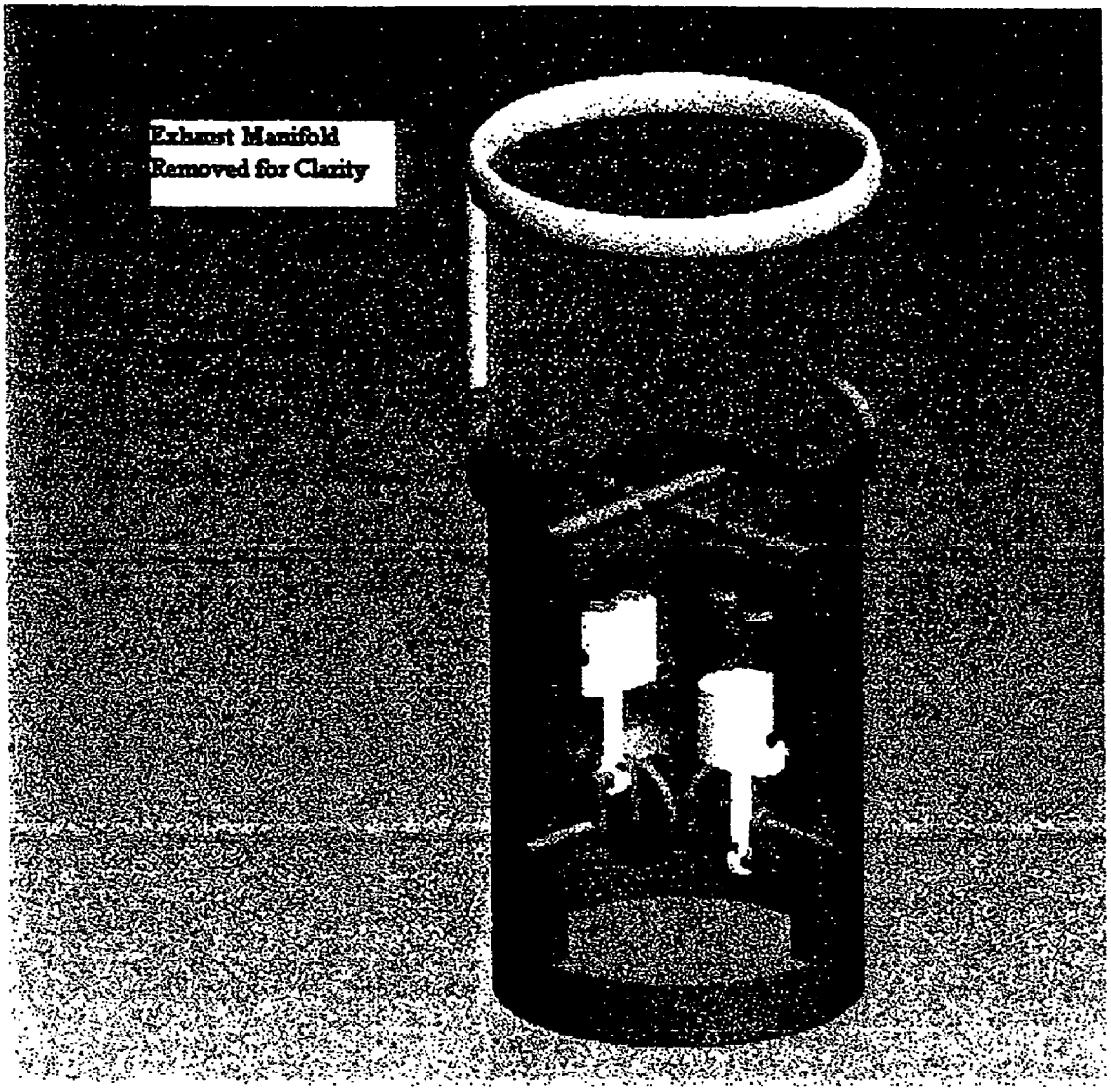
Figure 4 - Engine with Manifold Removed

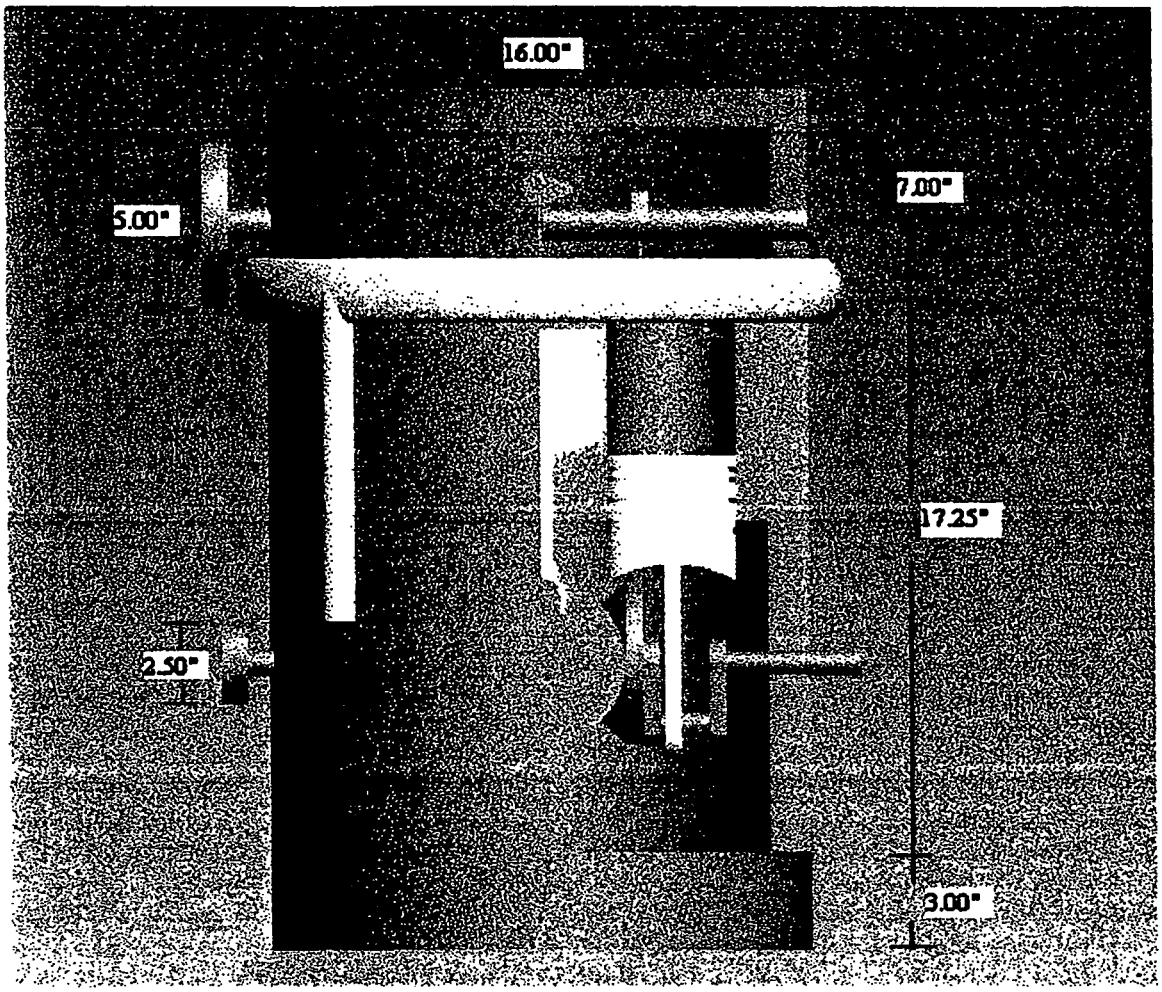
Figure 5 – Engine with Dimensions

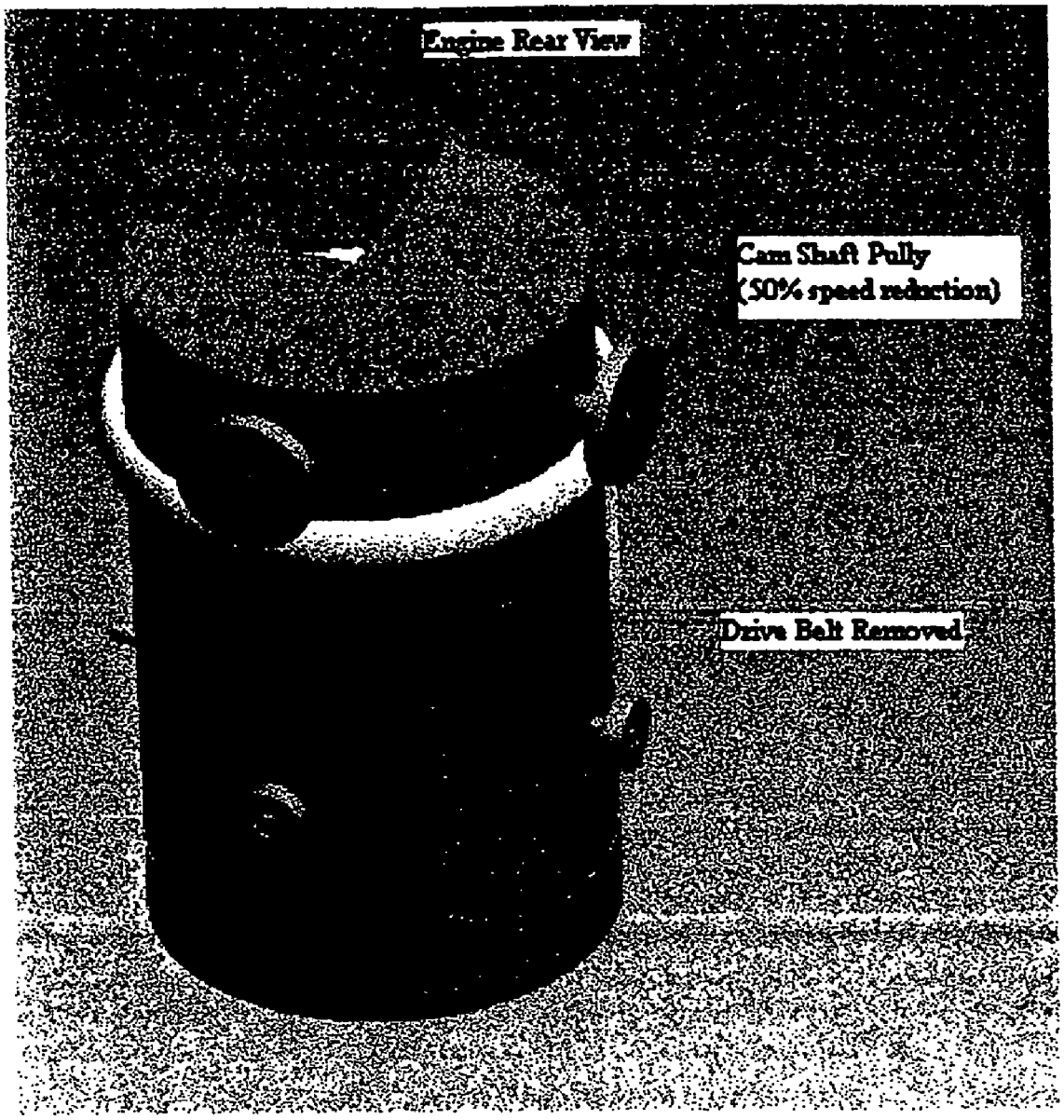
Figure 6 – Rear View of Engine

CYLINDRICAL ENGINE

This application claims benefit of priority to U.S. Provisional Patent Application No. 60/701,336, which was filed on Jul. 21, 2005.

BACKGROUND OF THE INVENTION

1. Field of the Invention

The invention is an internal combustion engine. It is a symmetrical block engine with cylinders in a novel cylindrical configuration. It is expected to reduce vibration and maintenance requirements while increasing efficiency and compactness capabilities. Any number of cylinders greater than two may be configured in the cylindrical configuration of this invention.

2. Summary of the Related Art

Many types and configurations of internal combustion engines are known. Typically, one or more pistons are connected to a crankshaft with connecting rods. In a typical multi-cylinder automotive engine, the cylinders are in either a "straight" (a.k.a. "in-line") or "V" configuration. Cylinders in a "straight" configuration align to form a single plane. Cylinders in a "V" configuration align to form two planes that meet at a common point where both planes of cylinders connect to a single crankshaft. The pistons cycle in a plane that is perpendicular to the plane of cylinder alignment (both planes of cylinder alignment if the engine is configured in a "V" formation). In a typical four-cylinder engine, two of the pistons are at the bottom of their stroke at the same time that the other two pistons are at the top of their stroke.

In addition to the "in-line" and "V-style" engines, radial engines are known and typically found in aircraft and model aircraft. In this configuration, the pistons are arranged radially about the crankshaft and the connecting rods frequently attach to each other on a lobe of the crankshaft or attach to a plate on the lobe of the crankshaft. In either case, the crankshaft is a single solid mass with eccentric sections to which the connecting rods attach for the transmission of power. In the instant invention, the crankshaft has been segmented into a plurality of interfacing beveled gears.

SUMMARY OF THE INVENTION

The invention is an internal combustion engine wherein the typical solid crankshaft has been replaced with a segmented crankshaft. The cylinders are arranged parallel to each other and are radially symmetrical around a center point. The connecting rod for each piston within each cylinder is linked to a crankshaft, which is connected to a beveled gear. Each beveled gear engages a beveled gear associated with an adjacent cylinder. At least one of the beveled gears has an output shaft to deliver power (e.g., crankshaft); however, more than one gear may have an output shaft. These additional output shafts may be used to power accessories such as power steering pumps, alternators, and air conditioner compressors.

This arrangement of cylinders provides for a naturally smoother operation with less vibration than in-line engines, better efficiency, and better gasket sealing. It also provides for simpler manufacturing of the engine block and head.

BRIEF DESCRIPTION OF THE DRAWING

FIG. 1—A preferred embodiment of the invention in which the internal combustion engine has four cylinders. The cylinders are identified as 1, 2, 3 and 4 in a counter clockwise direction. One cam shaft opens the valves for cylinders 1 and 3. A second cam shaft opens the valves for cylinders 2 and 4.

FIG. 2-I*sometric* drawing showing the four-segment crankshaft with bevel gears.

FIG. 3-T*op* view drawing of the four segment crank shaft

FIG. 4-M*odified* version of the drawing in FIG. 1 with the exhaust manifold removed for clarity.

FIG. 5-S*ide* view drawing of the engine with dimensions

FIG. 6-R*ear* view of the engine; showing the cam shaft pulleys.

FIG. 8 also shows how a space between two driven beveled gears allows the beveled gear arrangement of the present invention to function properly for any arrangement of odd numbers of cylinders.

FIG. 9 also shows how a non-driven gear (beveled or non-beveled) may be inserted between two driven beveled gears to allow the arrangement to function properly for any arrangement of odd numbers of cylinders.

FIG. 10 also shows how a non-driven gear (beveled or non-beveled) may be inserted between every driven beveled gear to allow the arrangement to function properly for any arrangement of odd numbers of cylinders.

DETAILED DESCRIPTION OF A PREFERRED EMBODIMENT OF THE INVENTION

The following example discloses a single preferred embodiment of the invention. It is meant merely to illustrate the invention and not to limit the invention. The skilled artisan in the practice of this invention will readily recognize that substitutions and alterations can be made while remaining within the metes and bounds of the invention, which are set forth in the claims that follow.

Figure 7:
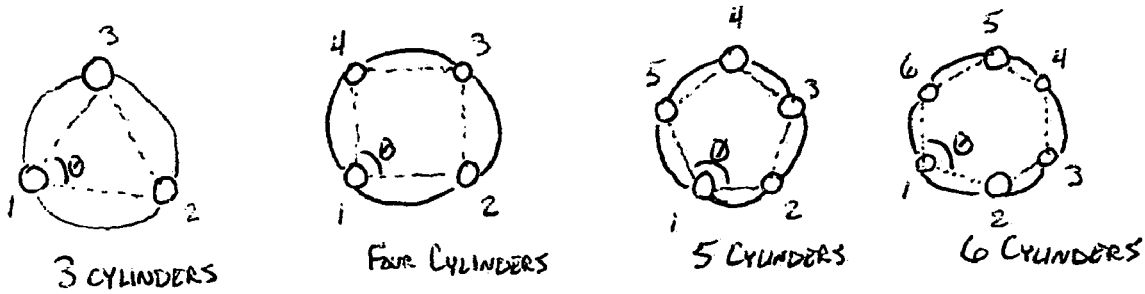
FIG. 7-F*our* cross sections of engine blocks with 3, 4, 5, and 6 cylinders arrayed in the shape of a circle according to this invention.

The invention is directed to an internal combustion engine comprising at least three cylinders that run parallel to each other. The cylinders are arrayed in a circle, radially symmetrical to each other in the plane perpendicular to the long axis of the cylinders. FIG. 7 depicts cross sections of four engine blocks to show how different numbers of cylinders may be arrayed according to this invention. In general, if each cylinder is viewed as a corner of an equal sided polygon, then the angle that a cylinder is oriented from each of its two next closest neighbors can be defined as:

$$\theta = 180 - \frac{360}{n},$$

where n is the number of cylinders (see FIG. 7).

For example, in a three cylinder engine embodiment, each cylinder would be equally spaced from each other as in the vertices of an equilateral triangle, each cylinder at 60° relative to its two closest neighboring cylinders (FIG. 7). In a four cylinder engine, the cylinders would form the four corners of a square, each cylinder oriented 90° from each neighbor (FIG. 7). In a five cylinder engine, each cylinder would form a corner of an equal sided pentagon, each cylinder oriented 108° from each neighbor (FIG. 7). In a six cylinder engine, each cylinder would form a corner of an equal sided hexagon, each cylinder oriented 120° from each neighbor (FIG. 7). Any number of cylinders, odd or even, may be arrayed in this manner. As the number of cylinders increases, the polygon formed more closely resembles a circle. Hence, the inventor refers to this as a "circular" engine. Alternatively, this invention could also be referred to as a cylindrical engine.

FIG. 1 depicts a preferred embodiment of the present invention. This embodiment has four cylinders ([1], [2], [3], and [4]) arrayed as previously described. The long axis of each cylinder is parallel to that of every other cylinder. The engine block [100] is cylindrical in shape. A cross section of the engine block [100] is the plane that is perpendicular to the long axis of the cylinders. When the cross section is viewed, each of the four cylinders are aligned at 90 degrees about the square (see FIG. 7).

Like traditional engines, the engine in FIG. 1 (and 4-6) includes an oil pan [105], an engine head [106], a valve cover [107], and an exhaust manifold [108]. The oil pan [105] is located at the bottom of the engine block [100]. The engine head [106], located at the top of the engine block [100], houses the intake ([51], [52], [53], and [54]) and exhaust ([61], [62], [63], and [64]) valves. The valve cover [107], located on top of the engine head [106], houses the valve cam shafts [90]. Multiple valve cam shafts are required depending on the number of cylinders because of this new configuration. An exhaust manifold [108] circles the perimeter of the engine block [100] or engine head [106] to provide a way for exhaust to escape from the engine.

A cylinder [1] houses a piston [11]. The piston [1] is connected to a connecting rod [21] on a crankshaft [31]. The piston [11] is also connected to a beveled gear [41], either via the connecting rod [21] or via the crankshaft [31]. The beveled gear [41] is located internally concentric to the radial cylinder array and the crankshaft [31] extends outward. Every cylinder ([1], [2], [3], and [4]) is configured in the same manner, previously described, with its own respective connecting rod ([21], [22], [23], and [24]), crankshaft ([31], [32], [33], and [34]), and beveled gear ([41], [42], [43], and [44]). (See FIG. 1).

The pistons are also configured 180 degrees out-of-phase from each other. As one piston [11] is drawn upward, another piston [12] is drawn down. The next piston counter-clockwise [13] is 180 degrees out-of-phase from the previous piston [12] and at zero phase angle from the first piston [11]. Finally, the last piston [14] is 180 degrees out-of-phase from the first [11] and third [13] pistons, but at zero phase angle from the second [12].

This arrangement of phasing is like that of the traditional inline four cylinder engine. As a piston [11] cycles through its four strokes (intake, compression, combustion, and exhaust; see reference 4), it drives its connecting rod [21] to rotate along its corresponding crankshaft [31]. The beveled gear [41] may be connected to the piston [11] directly via connecting rod [21] or indirectly via the crankshaft [31].

FIGS. 2, 3, B, C, and D depict different configurations of the beveled gears and segmented crankshafts. FIGS. 2 and 3 depict the configuration of a four cylinder embodiment of this invention. Figures B, C, and D depict different possible configurations of the beveled gears for a five cylinder embodiment of this invention. One skilled in the art should appreciate that similar configurations may be applied to any number of cylinders arrayed according to this invention, while still falling within the metes and bounds of this invention.

A beveled gear [41] engages at least one adjacent gear. In FIGS. 2 and 3, or for any engine with an even number of cylinders, a beveled gear [41] driven by a piston [11] may directly engage the two adjacent beveled gears ([42] and [44]) that are driven by the two adjacent pistons ([12] and [14], respectively). In figures A, B, and C, or for any engine with an odd number of cylinders, a problem results from having two adjacent gears rotating in the same direction. One skilled in the art should appreciate that this problem is easily solved.

In FIG. 7, for example, a small but sufficient space is between two gears ([41] and [45]), thereby allowing those two to rotate freely in the same direction. The two with the space between them ([41] and [45]) are directly engaged to one other adjacent driven beveled gear ([42] and [44], respectively), while each of the other beveled gears ([42], [43] and [44]) are adjacent to two other driven beveled gears (e.g. [42] is adjacent to [41] and [43], [43] is adjacent to [42] and [44], and [44] is adjacent to [43] and [45]).

Figure 8:
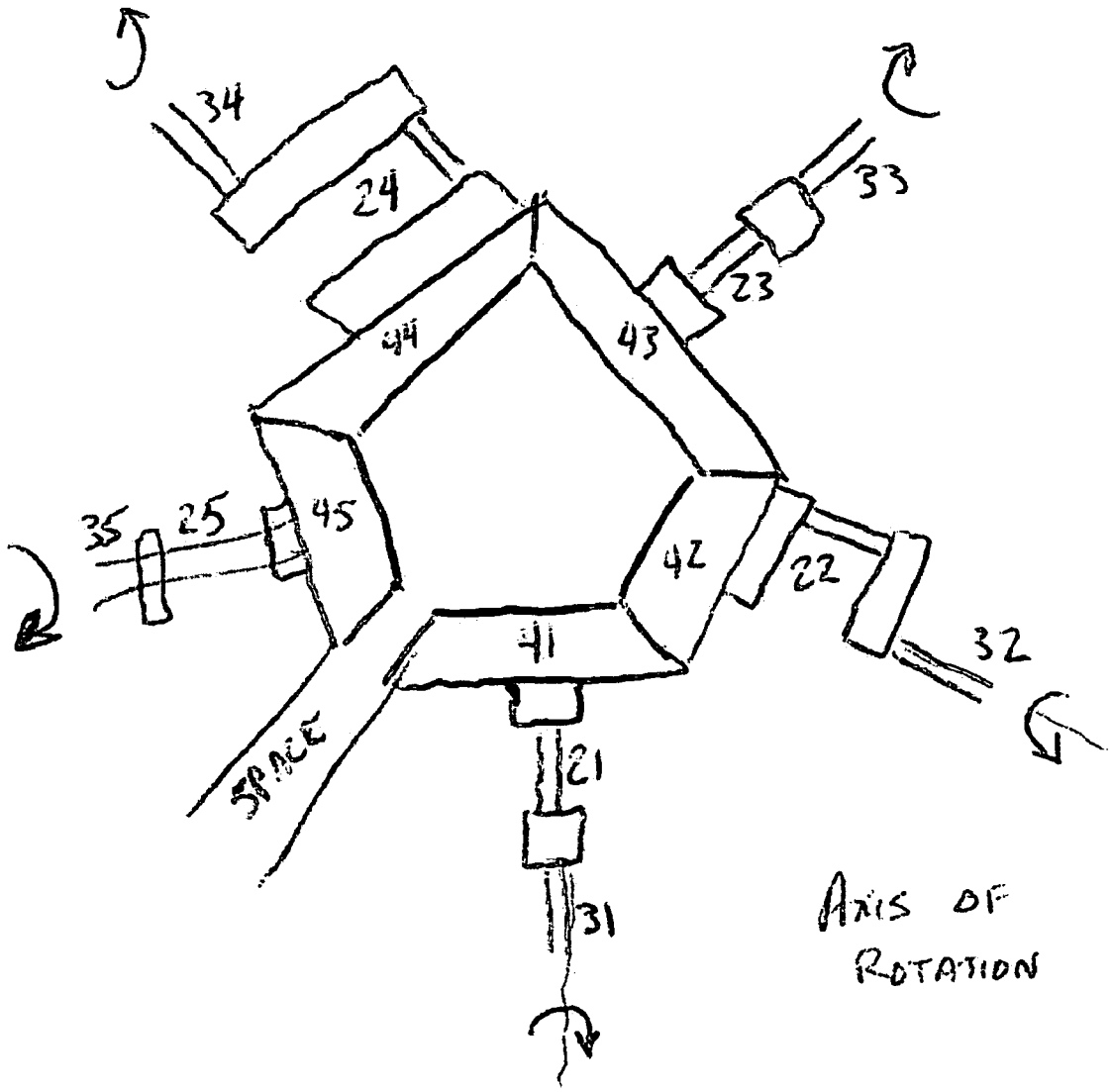
FIG. 8-T*op* view drawing of a five segment crank shaft.

Alternatively, in FIG. 8, a single non-driven gear ([110] beveled or [109] not beveled) could be placed between two driven beveled gears ([41] and [45]), thereby allowing those two ([41] and [45]) to rotate freely in the same direction. The two with the non-driven gear between them ([41] and [45]) are directly engaged to the non-driven gear ([110] beveled or [109] not beveled) and also to one driven beveled gear ([42] and [44], respectively), while each of the other beveled gears ([42], [43] and [44]) are adjacent to two other driven beveled gears (e.g. [42] is adjacent to [41] and [43], [43] is adjacent to [42] and [44], and [44] is adjacent to [43] and [45]).

Figure 9:
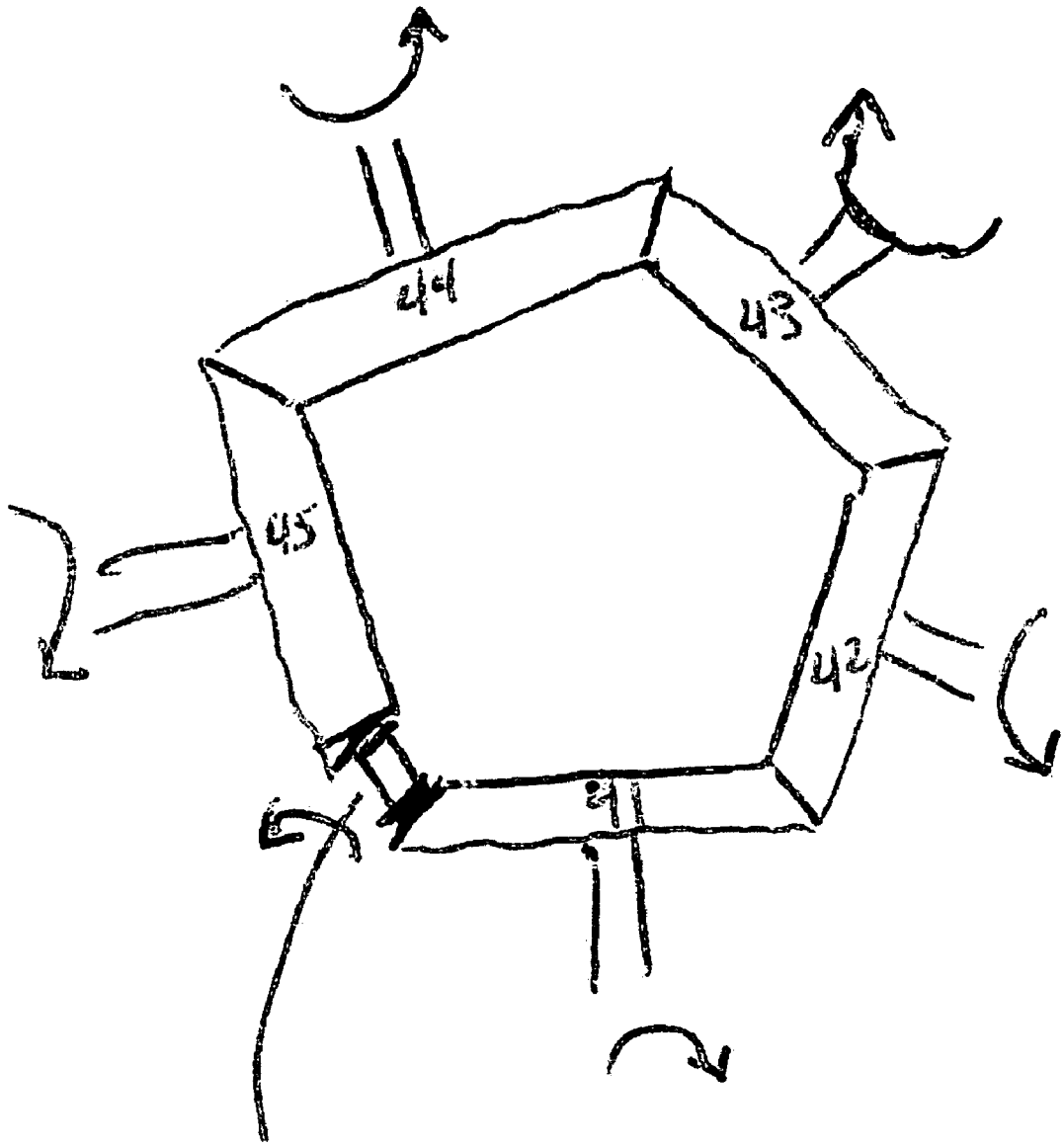
FIG. 9-T*op* view drawing of a five segment crankshaft.
Figure 10:
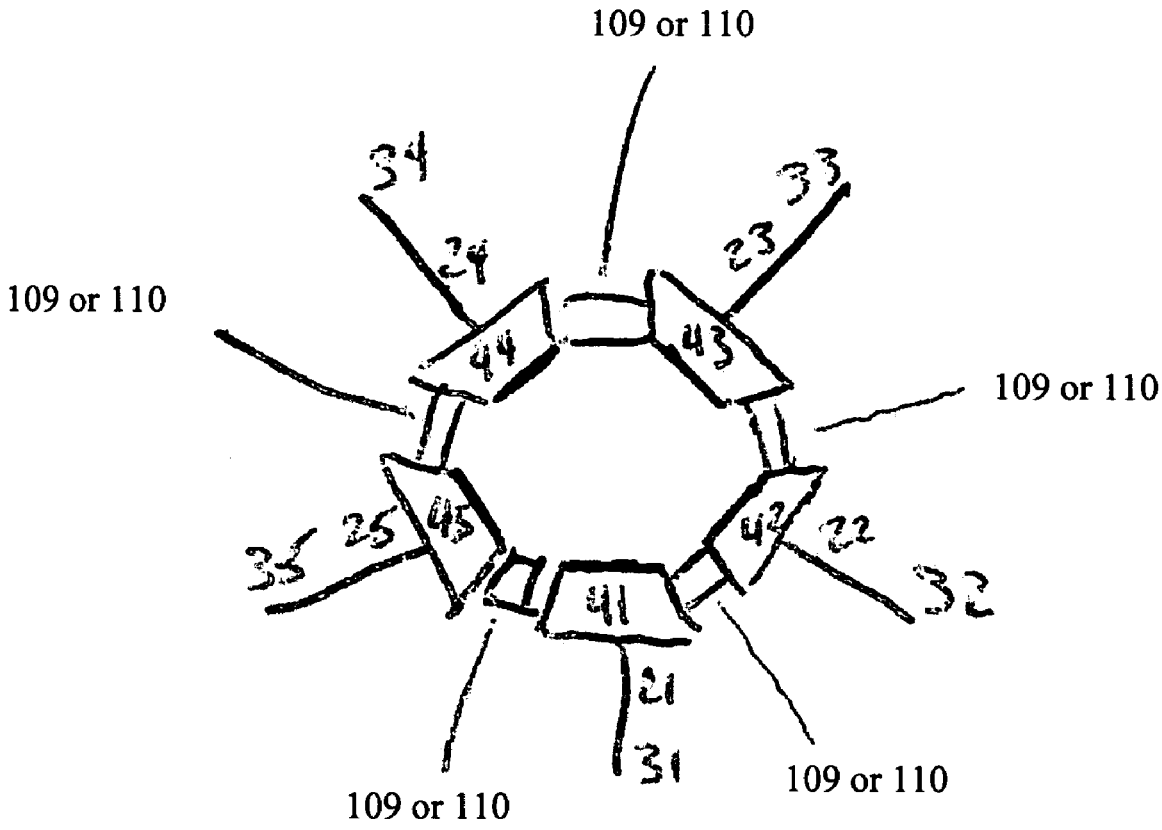
FIG. 10-T*op* view drawing of a five segment crankshaft.

Alternatively, in FIG. 9, a single non-driven gear ([110] beveled or [109] not beveled) could be placed between every driven beveled gear ([41], [42], [43], [44], and [45]), thereby allowing all to rotate freely in the same direction. Each driven beveled gear ([41], [42], [43], [44], and [45]) directly engages two non-driven gears ([110] beveled or [109] not beveled) and no driven gears, while each non-driven gear ([110] beveled or [109] not beveled) directly engages two driven beveled gears ([41], [42], [43], [44], and [45]).

There are several advantages of the new concept. The symmetry makes for a smoother running engine than the inline versions, with some vibrations damping out at the gear train. The protruding ends of the four crankshaft sections ([31], [32], [33], and [34]) make for better use of the crankshaft for flywheels, vibration dampers, added balancing weights, and various power-out uses such as air-conditioner, alternator, power steering, and others. The crankshafts ([31], [32], [33], and [34]) could also be used to drive the valve cam shafts [90], for example with a series of belts, pulleys, or gears. Crankshaft balance would be used as in a standard engine to reduce vibration forces at the individual cylinders, which in turn reduces local bending moments at the crankshaft section.

As noted above, one of the key advantages of this new concept is that the circular designs of the block [100], head [106], valve cover [107] and oil pan [105] allows for better gasket sealing as vibration at those joints are reduced. The gasket leakage in the in-line and V type engines results from vibration effects associated with gasket motion in those regions joining the block, pans, head, etc. Those gasket concerns are minimal, if not nonexistent, in this cylindrical design.

Manufacturing of the various parts would be simplified over the in-line and V types, as the casting or machining of the generally cylindrical shapes are a natural process for most shop procedures.

Though not shown, bearings would be required at the crankshaft sections ([31], [32], [33], and [34]), both at the beginning and end (at the gear attachments), so as to reduce the bending moments at the shaft sectors. The four cylinder embodiment of the present invention would use eight bearing, as opposed to five in a standard in-line four. This would make for a smoother engine compared to the inline. This valve arrangement is similar to a standard in-line engine with the option of multi-valves per cylinder, though a simple set-up is shown. Two camshafts [90] are used here to drive the valves, one shaft per each of the two groupings of crankshaft parts (one valve camshaft [90] per crankshafts [31] and [33] and a second valve camshaft [90] per crankshafts [32] and [34]). This is done for the purpose of proper timing of the valves. The cylinders fire in the order of cylinders [1], [3], [4], and [2] just as in the inline engine. Thus, the valves of cylinders [1] and [3] and the valves of cylinders [2] and [4] are the two groups connected herein.

Both intake and exhaust manifolds are simple to manufacture and to connect to the engine. An example of an exhaust manifold is shown here, however, one skilled in the art should recognize that many other configurations of intake or exhaust manifolds are possible and would still fall within the metes and bounds of this invention. The use of carburetors, or fuel injection, is optional. Similarly, diesel operation is readily available by increasing the compression ratio over the gasoline-powered version. There would likely be an added strength and thus weight to provide stronger structure to tolerate the increased pressures for the diesel version.

Water jackets are considered in the engine, and a standard radiator would be used. Standard engine mounts would be used to isolate the engine from the frame.

REFERENCES

The following references are cited by number throughout this disclosure. Applicant makes no statement, inferred or direct, regarding the status of these references as prior art. Applicant reserves the right to challenge the veracity of statements made in these references, which are incorporated herein by reference.

1. Duffy, J. E., "Auto Engines Technology," The Goodheart-Wilcox Co, Inc., 1997.
2. Pulkrabek, W. W., "Engineering Fundamentals of the Internal Combustion Engine," Prentice Hall Co, 1997.
3. Mabie, H. H., and Reinholtz, C. F., "Mechanics and Dynamics of Machinery," Fourth Edition, 1987.
4. Keveney, Matt. "Four Stroke Engine," http://www.keveney.com/otto.html, 2000.

What is claimed is:

1. An internal combustion engine comprising three (3) or more cylinders, wherein:

(a) each cylinder has a long axis and the long axis of each cylinder is parallel to the long axis of every other cylinder;

(b) the three or more cylinders are arrayed in a circle, radially symmetrical to each other in a plane that is perpendicular to the long axes of all of the cylinders;

(c) each cylinder houses a piston, wherein the piston is driven up and down the cylinder according to the engine's four strokes: intake, compression, combustion, and exhaust;

(d) each piston is linked to a connecting rod; and (e) each connecting rod is linked to a driven gear, wherein the driven gear is driven by the motion of the piston.

2. The internal combustion engine of claim 1, wherein each of the driven gears is a beveled gear.

3. The internal combustion engine of claim 1, wherein the driven gears are arrayed internally concentric to the circle of cylinders.

4. The internal combustion engine of claim 1, wherein each driven gear engages a driven gear of at least one adjacent cylinder.

5. The internal combustion engine of claim 1, wherein at least one driven gear has a crankshaft extending radially outward.

6. The internal combustion engine of claim 1, wherein at least one driven gear engages at least one adjacent, non-driven gear.

7. The internal combustion engine of any one of claims 1 through 3 and comprising four (4) cylinders, wherein each cylinder is set at 90 degree angle to each adjacent cylinder.

8. An internal combustion engine comprising four cylinders arranged parallel to each other and in a square pattern that is perpendicular to the long axis of the cylinders, each cylinder having at least one intake valve, at least one exhaust valve, one piston linked to a connecting rod that is linked to a beveled gear directed internal to the square pattern, wherein the beveled gear of each cylinder engages the beveled gear of both adjacent cylinders, and at least one beveled gear has an output shaft.

* * * * *